US007500335B1

(12) United States Patent
Kjose

(10) Patent No.: US 7,500,335 B1
(45) Date of Patent: Mar. 10, 2009

(54) PORTABLE DECK FOR RECREATIONAL VEHICLES AND FIFTH WHEEL CAMPERS

(76) Inventor: Eldean Kjose, 103 Pine Ln, Alcester, SD (US) 57001

( * ) Notice: Subject to any disclaimer, the term of this patent is extended or adjusted under 35 U.S.C. 154(b) by 750 days.

(21) Appl. No.: 10/782,145

(22) Filed: Feb. 19, 2004

(51) Int. Cl.
*E04F 11/00* (2006.01)

(52) U.S. Cl. ..... 52/182; 52/184; 52/263; 52/79.5

(58) Field of Classification Search ..... 52/182–191, 52/263, 79.5, 79.6; 182/113, 115, 151, 152, 182/156; 256/21, 22, 24, 59, 65, 66
See application file for complete search history.

(56) References Cited

U.S. PATENT DOCUMENTS 3,217,366 A * 11/1965 Wenger ..... 52/6
3,258,884 A * 7/1966 Wenger ..... 52/6
3,750,351 A * 8/1973 Greenburg ..... 52/64
3,808,757 A * 5/1974 Greenwood ..... 52/184
3,875,707 A 4/1975 Horn
3,912,298 A * 10/1975 Humphrey ..... 280/166
4,622,792 A * 11/1986 Betts ..... 52/263
4,691,484 A * 9/1987 Wilson ..... 52/79.6
4,747,243 A * 5/1988 Anstead ..... 52/184
4,759,162 A * 7/1988 Wyse ..... 52/126.6
4,823,529 A * 4/1989 Canfield et al. ..... 52/263
5,049,700 A * 9/1991 Kobayashi et al. ..... 174/482
5,152,109 A * 10/1992 Boers ..... 52/143
5,313,756 A * 5/1994 Ways et al. ..... 52/263
5,325,640 A * 7/1994 Luedke et al. ..... 52/9
5,511,353 A 4/1996 Jones
5,653,459 A * 8/1997 Murphy ..... 280/166
5,713,171 A * 2/1998 Andres ..... 52/263
5,758,467 A 6/1998 Snear et al.
5,761,854 A * 6/1998 Johnson et al. ..... 52/69
5,901,396 A 5/1999 Ahlskog et al.
5,906,084 A 5/1999 Millington et al.
6,106,186 A 8/2000 Taipale et al.
6,128,880 A * 10/2000 Meenan, Jr. ..... 52/489.1
6,209,267 B1 * 4/2001 Dantzer ..... 52/79.6
6,763,912 B2 * 7/2004 Robinson et al. ..... 182/115
6,810,995 B2 * 11/2004 Warford ..... 182/115

* cited by examiner

*Primary Examiner*—Basil Katcheves

(57) ABSTRACT

A portable deck system for recreational vehicles and fifth wheel campers for enhancing the accessibility of an elevated exterior door. The system includes a platform assembly having a top surface positionable adjacent to a threshold of the entry door, a plurality of legs extending between the ground and the platform assembly and hingeably coupled to the platform assembly. An access assembly is operationally coupleable to the platform assembly, and provides a vertical transition between the platform assembly and ground level. A railing assembly extends along at least a portion of the platform for providing a hand grip for the user.

6 Claims, 3 Drawing Sheets

PORTABLE DECK FOR RECREATIONAL VEHICLES AND FIFTH WHEEL CAMPERS

BACKGROUND OF THE INVENTION

1. Field of the Invention

The present invention relates to modular decking systems and more particularly pertains to a new portable deck for recreational vehicles and fifth wheel campers for enhancing the accessibility of recreational vehicles and fifth wheel campers when parked.

2. Description of the Prior Art

The use of modular decking systems is known in the prior art. Illustrative examples include: U.S. Pat. No. 3,750,351; U.S. Pat. No. 3,875,707; U.S. Pat. No. 5,511,353; U.S. Pat. No. 6,128,880; U.S. Pat. No. 5,906,084; U.S. Pat. No. 5,758,467; U.S. Pat. No. 4,622,792; U.S. Pat. No. 5,901,396; and U.S. Pat. No. 6,106,186.

While these devices fulfill their respective, particular objectives and requirements, the need remains for a system that can be readily disassembled and reassembled as needed with a minimum of tools.

SUMMARY OF THE INVENTION

Recreational vehicles and fifth wheel campers (collective RV's as used hereafter) provide an enjoyable means of travel for a wide cross-section of the population. However, the retired community encompasses a large portion of RV enthusiasts. Many of these RV's provide an elevated entry door for accessing an interior of the RV. Most of these RVs also include stairs which are foldable stored below the elevated entry door and may be extended when needed, such as when the RV is parked.

Because of the need to conserve space inherent in this type of mobile shelter, the stairs normally have a width approximately equal to the width of the entry door. This configuration, while being space efficient is inconvenient, especially for older users. The elevated entry door sweeps outwardly across the stairs when opened, forcing a user to either lean away from the opening door from a lower step, or step around the door as it is opened.

A wider entry area is needed to provide a safe entry for all users, but especially older users and those with some physical limitations.

The present invention meets the needs presented above by providing a lightweight modular deck system which can be erected on-site without tools, and disassembled as needed.

An advantage of the present invention is to provide a new portable deck for RV's that includes telescopic legs for adjusting both for the height of the threshold of the elevated entry door of the RV, and for adjusting for uneven terrain below the portable deck.

Another advantage of the present invention is to provide a new portable deck for RV's that can be stored in a storage compartment located in a side of the RV.

To this end, the present invention generally comprises a platform assembly having a top surface positionable adjacent to a threshold of the entry door, a plurality of legs extending between the ground and the platform assembly and hingeably coupled to the platform assembly. An access assembly is operationally coupleable to the platform assembly, and provides a vertical transition between the platform assembly and ground level. A railing assembly extends along at least a portion of the platform for providing a hand grip for the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
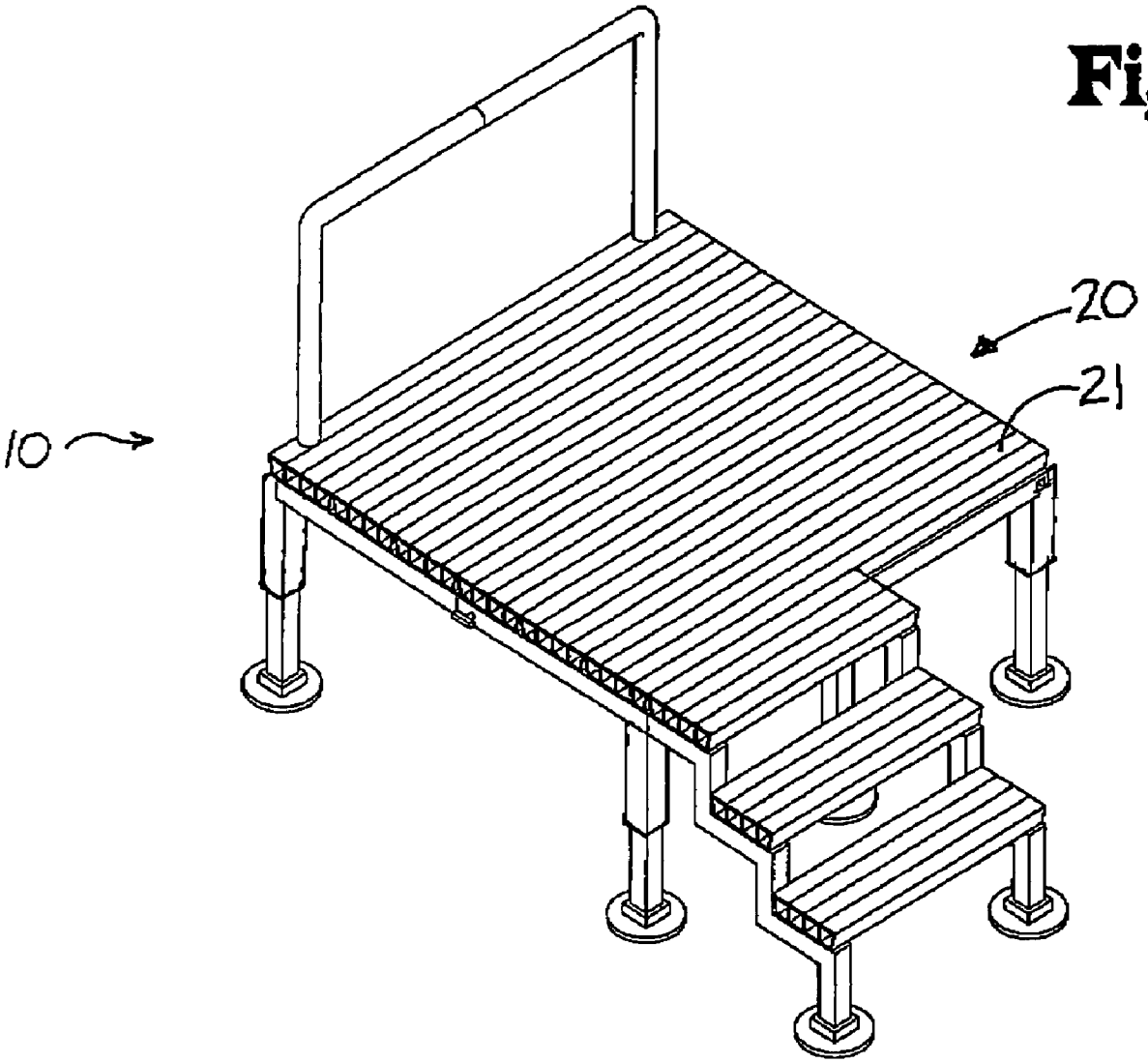
FIG. 1 is a schematic perspective view of a new portable (disassembleable) deck for rv's and 5th wheel campers according to the present invention in use.
Figure 2:
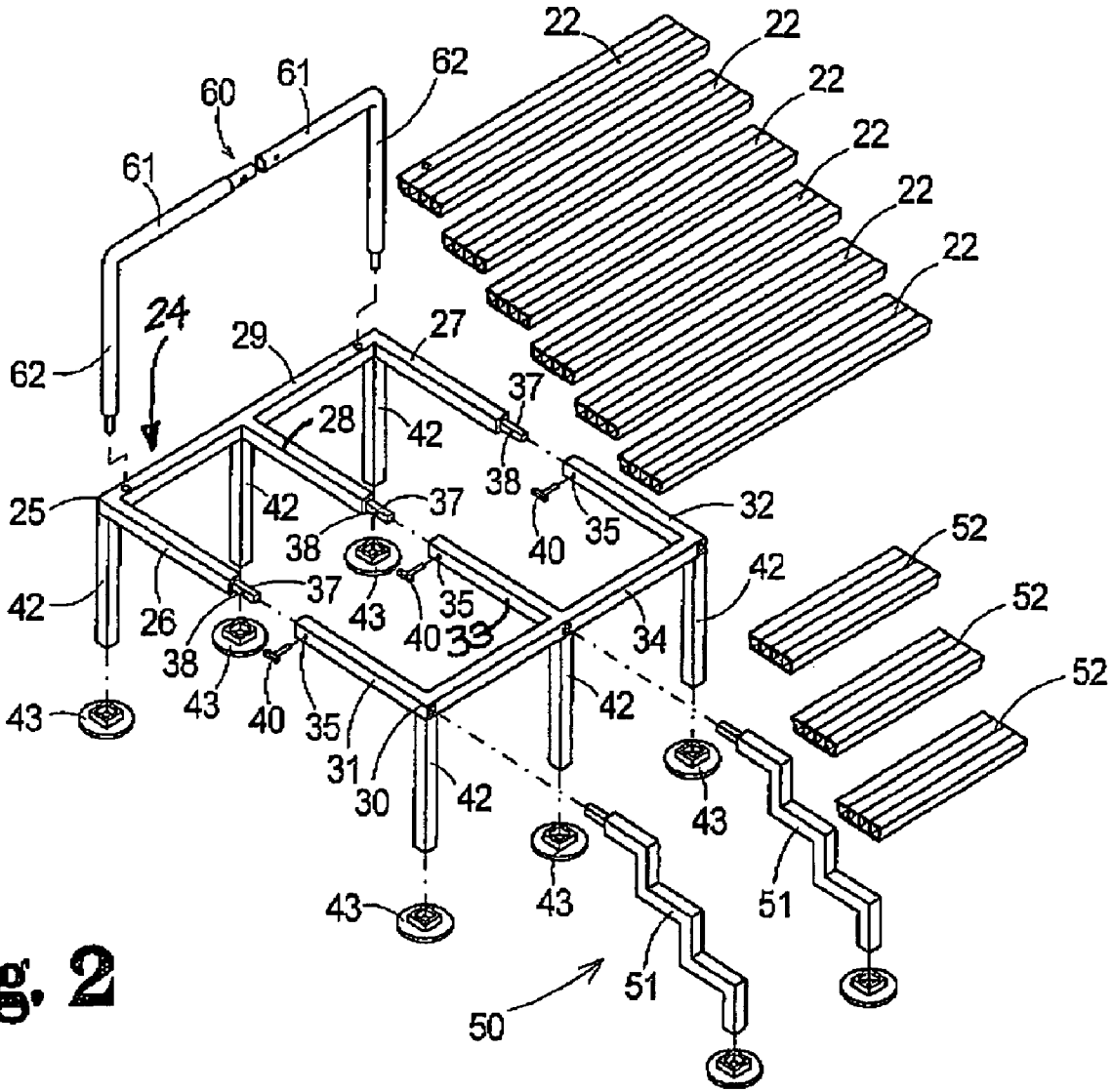
FIG. 2 is a schematic perspective exploded view of the present invention.
Figure 3:
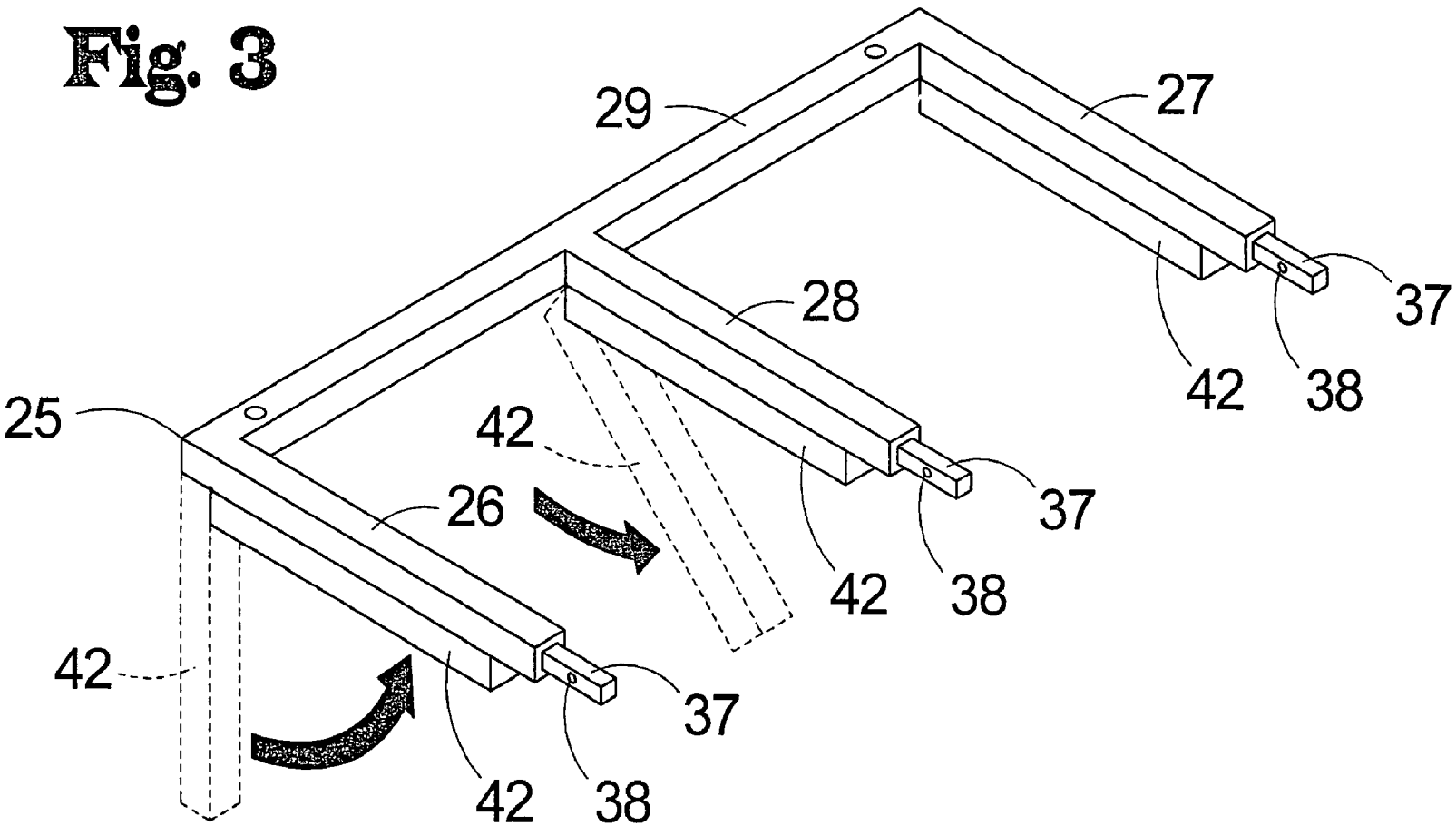
FIG. 3 is a schematic perspective view of the first support frame assembly of the present invention with legs in the stored position.

With reference now to the drawings, and in particular to FIGS. 1 through 3 thereof, a new portable deck for recreational vehicles and fifth wheel campers embodying the principles and concepts of the present invention and generally designated by the reference numeral 10 will be described.

As best illustrated in FIGS. 1 through 3, the new portable deck for recreational vehicles and fifth wheel campers 10 generally comprises a platform assembly 20 and an access means 50.

The platform assembly 20 includes a top surface 21 positionable adjacent to a threshold of the entry door. The platform assembly 20 provides a horizontal space for a user external to the entry door. The access means 50 is operationally coupleable to the platform assembly 20, and provides a vertical transition between the platform assembly 20 and ground level.

Preferably, the access means 50 is a stair assembly, but a ramp or lift assembly may also be used with satisfactory results.

In an embodiment the platform assembly 50 further comprises a plurality of decking members 22, a horizontal support frame assembly 24, and a plurality of leg members 42. Each one of the plurality of decking members 22 includes a top portion forming the top surface 21 of the platform assembly 20. The horizontal support frame assembly 24 provides a horizontal support surface to each one of the plurality of decking members 22. Each one of the leg members 42 is operationally coupleable to the horizontal support frame assembly 24. Each one of the plurality of leg members 42 provides vertical support to the horizontal support frame assembly 24.

Most preferably, each one of the plurality of leg members 42 is hingeably coupled to the horizontal support frame assembly 24 to facilitate folding of the platform assembly 20 for storage and transportation.

In an embodiment at least one of the plurality of leg members 42 is telescopic for adjusting a length of the at least one leg member 42. Preferably, each one of the leg members 42 is telescopic.

In an embodiment the horizontal support frame assembly 24 further comprises a first portion (or first support frame assembly 25) and a second portion (or second support frame assembly 30). The first portion is selectively coupleable to the second portion for use supporting the plurality of decking members 22. The first portion is selectively separable from the second portion to facilitate storage and transport of the horizontal support frame assembly 24.

In a further embodiment, the plurality of leg member 42 comprises six leg members 42. A leg member 42 is hingeably secured to the horizontal support frame assembly adjacent to each corner of the horizontal support frame 24. The remaining two legs 42 are hingeably coupled to a medial portion of an associated one of said first portion and second portion.

More preferably, the plurality of leg member 42 comprises four leg members 42. A leg member 42 is hingeably secured to the horizontal support frame assembly adjacent to each corner of the horizontal support frame 24.

In a further preferred embodiment, the first support frame assembly 24 comprises a first tubular horizontal member which further includes a first lateral extent 26, a second lateral extent 27, a third lateral extent 28, and a longitudinal extent 29. The longitudinal extent 29 extends between the first lateral extent 26 and the second lateral extent 27. The third lateral extent 28 is positioned between the first lateral extent 26 and the second lateral extent 27, and is coupled to a medial portion of the longitudinal extent 29. The first tubular horizontal member is substantially E-shaped. Similarly, the second support frame assembly 30 comprises a second tubular horizontal member which further includes a fourth lateral extent 31, a fifth lateral extent 32, a sixth lateral extent 33, and a second longitudinal extent 34. The second longitudinal extent 34 extends between the fourth lateral extent 31 and the fifth lateral extent 32, and is positioned between the fourth lateral extent 31 and the fifth lateral extent 32. The sixth lateral extent 33 is coupled to a medial portion of the second longitudinal extent 34. The second tubular horizontal member is also substantially E-shaped. Each one of the leg member 42 may be folded to abut an associated lateral extent to facilitate storage and transport.

In still a further embodiment, the platform assembly 20 includes a trio of lateral extent splice members 37. Each one of the trio of lateral extent splice members 37 includes a first end fixedly coupled to a distal end of an associated one of the first lateral extent 26, second lateral extent 27, and third lateral extent 28. Each one of the trio of lateral extent splice members includes a second end with an aperture 38 extending therethrough. Each one of the fourth lateral extent 31, fifth lateral extent 32, and sixth lateral extent 33 includes a distal end with a mating aperture 35 extending therethrough. The second end of each one of the trio of lateral extent splice members 37 is slideably receivable within the distal end of an associated one of the fourth lateral extent 31, fifth lateral extent 32, and sixth lateral extent 33. The aperture 38 extending through each one of the second ends of the trio of lateral extent splice members 37 is alignable with an associated one of the mating aperture 35 of the fourth lateral extent 31, fifth lateral extent 32, and sixth lateral extent 33. Each one of a trio of pin members 40 is positionable through an associated pair of an aperture 38 and a mating aperture 35. Thus, the first support frame assembly 25 is coupled to the second support frame assembly 30.

For the purposes of the description only, the splices as described above were assumed to be fixedly coupled to the first support frame assembly. However, they may be fixedly attached to the second support frame assembly, two may be coupled to one support frame assembly and one to the other support assembly, or all three may be coupleable rather than fixedly coupled.

In even still a further embodiment, a base portion 43 is coupled to a distal end of each one of the plurality of leg members 42. The base portion 43 provides an enlarged surface area for contacting the ground and inhibiting the leg member 42 from sinking below ground level.

Preferably, the stair assembly includes a stair frame assembly 51 and a plurality of stair treads 52. The stair frame assembly 51 provides a plurality of incremental vertical supports between ground level and the platform assembly. Each one of the stair treads 52 is coupleable to an associated one of the plurality of incremental vertical supports. The stair frame assembly 51 is selectively coupleable to the platform assembly 20 to facilitate access between the platform assembly 20 and ground level. The stair frame assembly 51 is also selectively separable from the platform assembly 20 to facilitate storage and transportation of the access means.

At least one embodiment includes a secondary stair assembly 55 is operationally couplable to the stair assembly 51. The secondary stair assembly 55 provides additional incremental vertical supports between ground level and a first one of the incremental vertical supports of the stair assembly 51 to facilitate use of the platform assembly with entry doors includes a threshold height requiring additional stairs for access.

A railing assembly 60 includes at least one handrail portion 61 and at least two vertical stanchions 62. The handrail portion 61 is positioned between the at least two vertical stanchions 62. Each of the two vertical stanchions 62 is coupleable to the platform assembly 20. Preferably, the members of the railing assembly 60 have a circular cross-section to provide both a visual and physical differentiation between members of the railing assembly 60 and members of the platform assembly 20 and stair assembly 51. Additionally, the circular cross-section provides and enhanced gripping surface for the user over a square or other angular cross-section.

In use, the user removes the components from a storage compartment in the RV after arriving at a camp site or other destination. The legs are unfolded from the first and second portions of the horizontal support assembly into a deployed position and locked into place. The first and second portions of the horizontal support assembly are coupled together and the placed adjacent to the elevated exterior door of the RV. The decking members are coupled to the horizontal support assembly. The stair frame assembly is coupled to the platform assembly and each one of the stair treads is coupled to an associated one of the incremental vertical supports of the stair frame assembly. The members of the railing assembly are coupled together and to the platform assembly. Finally, the system may be secured to the RV to prevent movement of the system relative to the RV. The process is reversed when the user is ready to leave the campsite or other destination.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable deck system for use with conventional recreational vehicles and fifth wheel campers having an entry door above ground level, the system comprising:

a platform assembly having a top surface positionable adjacent to a threshold of the entry door, said platform assembly providing a horizontal space for a user external to the entry door;

a stair assembly operationally coupleable to said platform assembly, said stair assembly providing a vertical transition between said platform assembly and ground level;

said platform assembly including a plurality of decking members, a first support frame assembly and a second support frame assembly;

said first support assembly being selectively couplable to said second support assembly to support said plurality of decking members, said first support assembly being selectively separable from said second support assembly to facilitate storage and transport of said platform assembly;

said platform assembly further comprising a trio of leg members, each one of said trio of leg member being hinged to said first support assembly, each one of said trio of leg members being telescopic to adjust an overall height of said leg member;

said platform assembly further comprising a second trio of leg members, each one of said second trio of leg members being hinged to said second support assembly, each one of said second trio of leg members being telescopic to adjust an overall height of said leg member;

each one of said plurality of decking members being selectively coupleable to an associated one of said first support assembly and said second support assembly;

wherein said stair assembly further comprises:

a stair frame assembly providing a plurality of incremental vertical supports between ground level and said platform assembly;

a plurality of stair treads, each one of said stair treads being coupleable to an associated one of said plurality of incremental vertical supports;

said stair frame assembly being selectively coupleable to said platform assembly to facilitate access between said platform assembly and ground level, said stair frame assembly being selectively separable from said platform assembly to facilitate storage and transportation of said access means;

a railing assembly having at least one handrail portion and at least two vertical stanchions, said at least one handrail portion being positioned between said at least two vertical stanchions, each one of said at least two vertical stanchions being coupleable to said platform assembly;

said first support frame assembly comprising a first tubular horizontal member having a first lateral extent, a second lateral extent, a third lateral extent, and a longitudinal extent, said longitudinal extent extending between said first lateral extent and said second lateral extent, said third lateral extent being positioned between said first lateral extent and said second lateral extent, said third lateral extent being coupled to a medial portion of said longitudinal extent, said first tubular horizontal member being substantially E-shaped;

said second support frame assembly comprising a second tubular horizontal member having a fourth lateral extent, a fifth lateral extent, a sixth lateral extent, and a second longitudinal extent, said second longitudinal extent extending between said fourth lateral extent and said fifth lateral extent, said sixth lateral extent being positioned between said fourth lateral extent and said fifth lateral extent, said sixth lateral extent being coupled to a medial portion of said second longitudinal extent, said second tubular horizontal member being substantially E-shaped.

2. The system of claim 1, wherein said platform assembly further comprises:

a trio of lateral extent splice members, each one of said trio of lateral extent splice members having a first end fixedly coupled to a distal end of an associated one of said first lateral extent, second lateral extent, and third lateral extent, each one of said trio of lateral extent splice members having a second end with an aperture extending therethrough;

each one of said fourth lateral extent, fifth lateral extent, and sixth lateral extent having a distal end with a mating aperture extending therethrough;

said second end of each one of said trio of lateral extent splice members being slideably receivable within said distal end of an associated one of said fourth lateral extent, fifth lateral extent, and sixth lateral extent;

said aperture extending through each one of said second ends of said trio of lateral extent splice members being alignable with an associated one of said mating aperture of said fourth lateral extent, fifth lateral extent, and sixth lateral extent; and a trio of pin members, each one of said pin members being positionable through an associated pair of an aperture and a mating aperture whereby said first support frame assembly is coupled to said second support frame assembly.

3. The system of claim 1, further comprising:

each one of said lateral extents and longitudinal extents of said first support frame assembly and said second support frame assembly having a generally square cross-section facilitating identification of said first and second support assemblies as part of said platform assembly;

said at least one handrail portion and said at least two vertical stanchions each having a generally round cross-section facilitating identification of said handrail and stanchion assemblies as part of said railing assembly.

4. The system of claim 1, further comprising a securing means for selectively coupling said platform assembly to said recreational vehicle to inhibit movement of said platform assembly relative to said recreational vehicle.

5. A portable deck system for use with conventional recreational vehicles and fifth wheel campers having an entry door above ground level, the system comprising:

a platform assembly having a top surface positionable adjacent to a threshold of the entry door, said platform assembly providing a horizontal space for a user external to the entry door;

a stair assembly operationally coupleable to said platform assembly, said stair assembly providing a vertical transition between said platform assembly and ground level;

said platform assembly including a plurality of decking members, a first support frame assembly and a second support frame assembly;

said first support assembly being selectively couplable to said second support assembly to support said plurality of decking members, said first support assembly being selectively separable from said second support assembly to facilitate storage and transport of said platform assembly;

said platform assembly further comprising a pair of leg members, each one of said pair of leg member being hinged to said first support assembly, each one of said pair of leg members being telescopic to adjust an overall height of said leg member;

said platform assembly further comprising a second pair of leg members, each one of said second pair of leg members being hinged to said second support assembly, each one of said second pair of leg members being telescopic to adjust an overall height of said leg member;

each one of said plurality of decking members being selectively coupleable to an associated one of said first support assembly and said second support assembly;

wherein said stair assembly further comprises:

a stair frame assembly providing a plurality of incremental vertical supports between ground level and said platform assembly;

a plurality of stair treads, each one of said stair treads being coupleable to an associated one of said plurality of incremental vertical supports;

said stair frame assembly being selectively coupleable to said platform assembly to facilitate access between said platform assembly and ground level, said stair frame assembly being selectively separable from said platform assembly to facilitate storage and transportation of said access means;

a railing assembly having at least one handrail portion and at least two vertical stanchions, said at least one handrail portion being positioned between said at least two vertical stanchions, each one of said at least two vertical stanchions being coupleable to said platform assembly;

wherein said platform assembly further comprises:

a trio of lateral extent splice members, each one of said trio of lateral extent splice members having a first end fixedly coupled to a distal end of an associated one of said first lateral extent, second lateral extent, and third lateral extent, each one of said trio of lateral extent splice members having a second end with an aperture extending therethrough;

each one of said fourth lateral extent, fifth lateral extent, and sixth lateral extent having a distal end with a mating aperture extending therethrough;

said second end of each one of said trio of lateral extent splice members being slideably receivable within said distal end of an associated one of said fourth lateral extent, fifth lateral extent, and sixth lateral extent;

said aperture extending through each one of said second ends of said trio of lateral extent splice members being alignable with an associated one of said mating aperture of said fourth lateral extent, fifth lateral extent, and sixth lateral extent; and a trio of pin members, each one of said pin members being positionable through an associated pair of an aperture and a mating aperture whereby said first support frame assembly is coupled to said second support frame assembly.

6. The system of claim 5, further comprising:

each one of said lateral extents and longitudinal extents of said first support frame assembly and said second support frame assembly having a generally square cross-section facilitating identification of said first and second support assemblies as part of said platform assembly;

said at least one handrail portion and said at least two vertical stanchions each having a generally round cross-section facilitating identification of said handrail and stanchion assemblies as part of said railing assembly; and a securing means for selectively coupling said platform assembly to said recreational vehicle to inhibit movement of said platform assembly relative to said recreational vehicle.

* * * * *